US007263846B2

(12) United States Patent
Hwang et al.

(10) Patent No.: US 7,263,846 B2
(45) Date of Patent: Sep. 4, 2007

(54) REFRIGERANT BYPASSING AND FILTERING APPARATUS OF AIR CONDITIONER AND METHOD FOR CONTROLLING THE SAME

(75) Inventors: Il Nahm Hwang, Yongin-si (KR); Seok Ho Yoon, Yongin-si (KR); Pil Hyun Yoon, Seoul (KR); Ho Jong Jeong, Seoul (KR); Won Chul Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 122 days.

(21) Appl. No.: 11/194,469

(22) Filed: Aug. 2, 2005

(65) Prior Publication Data

US 2006/0107688 A1 May 25, 2006

(30) Foreign Application Priority Data

Nov. 23, 2004 (KR) ..... 10-2004-0096333

(51) Int. Cl.
*F25B 5/00* (2006.01)
*F25B 43/00* (2006.01)

(52) U.S. Cl. ..... 62/117; 62/474

(58) Field of Classification Search ..... 62/117, 62/195, 197, 474, 475
See application file for complete search history.

(56) References Cited

U.S. PATENT DOCUMENTS 3,948,679 A * 4/1976 Lewis ..... 134/10
4,263,787 A * 4/1981 Domingorena ..... 62/324.6
5,115,645 A * 5/1992 Abraham ..... 62/292
5,737,931 A * 4/1998 Ueno et al. ..... 62/126
6,223,549 B1 * 5/2001 Kasai ..... 62/324.1
6,584,796 B2 * 7/2003 Itoh et al. ..... 62/324.1
6,637,227 B2 * 10/2003 Stensrud et al. ..... 62/217
6,971,245 B2 * 12/2005 Kuroyanagi ..... 62/136
7,104,087 B2 * 9/2006 Park et al. ..... 62/474
2004/0134224 A1 * 7/2004 Park et al. ..... 62/474
2004/0164009 A1 * 8/2004 Smith ..... 210/132
2005/0028549 A1 * 2/2005 Kuroyanagi ..... 62/352

(Continued)

FOREIGN PATENT DOCUMENTS

CN 2526756 12/2002

(Continued)

OTHER PUBLICATIONS

English Language Abstract of Jp 10-185369.

(Continued)

*Primary Examiner*—Mohammad M. Ali
(74) *Attorney, Agent, or Firm*—Greenblum & Bernstein, P.L.C.

(57) ABSTRACT

A refrigerant bypassing and filtering apparatus of an air conditioner is disclosed which is capable of effectively removing foreign matter such as slag produced in a refrigerant line, not only when the air conditioner is initially operated, but also during normal operation of the air conditioner. The apparatus includes at least one bypass line adapted to guide a refrigerant to bypass a main line through which the refrigerant flows between an outdoor unit and an indoor unit, a strainer arranged at the bypass line, a first valve arranged at the main line between opposite ends of the bypass line connected to the main line, and second valves arranged at the bypass line.

18 Claims, 4 Drawing Sheets

U.S. PATENT DOCUMENTS

2005/0044877 A1 3/2005 Chin et al.
2005/0044882 A1 3/2005 Hong et al.
2005/0081545 A1* 4/2005 Gist et al. ..... 62/217

FOREIGN PATENT DOCUMENTS

JP 10-185369 7/1998
JP 2001-141341 5/2001
JP 2001-255045 9/2001
JP 2004-324949 A * 11/2004

OTHER PUBLICATIONS

English Language Abstract of JP 2001-141341.
English Language Abstract of JP 2001-255045.

* cited by examiner

REFRIGERANT BYPASSING AND FILTERING APPARATUS OF AIR CONDITIONER AND METHOD FOR CONTROLLING THE SAME

This application claims the benefit of Korean Patent Application No. 10-2004-0096333, filed on Nov. 23, 2004, which is hereby incorporated by reference as if fully set forth herein.

BACKGROUND OF THE INVENTION

1. Field of the Invention

The present invention relates to an air conditioner, and more particularly, to a refrigerant bypassing and filtering apparatus of an air conditioner which filters a refrigerant circulated in the air conditioner to remove foreign matter from the refrigerant, and a method for controlling the refrigerant bypassing and filtering apparatus.

2. Discussion of the Related Art

Generally, air conditioning systems perform procedures of compressing, condensing, expanding and evaporating a refrigerant to cool and/or heat a confined space. Such air conditioning systems are classified into a cooling type wherein a refrigerant flows only in one direction through a refrigerant cycle, to supply cold air to a confined space, and a cooling and heating type wherein a refrigerant flows bi-directionally in a selective manner through a refrigerant cycle, to selectively supply cold air or hot air to a confined space.

Also, such air conditioning systems are classified into a general type wherein one indoor unit is connected to one outdoor unit, and a multi-unit type wherein a plurality of indoor units are connected to one outdoor unit. For the multi-unit type, an air conditioner may be implemented which includes at least one outdoor unit.

Multi-unit air conditioners are classified into a switching type wherein all indoor units operate in the same operating mode, that is, in cooling mode or heating mode alone, and a simultaneous type wherein a part of the indoor units operate in cooling mode, and the remaining indoor unit or indoor units operate in heating mode.

Meanwhile, such a multi-unit air conditioner is mainly used for an air conditioning system installed in a large-scale structure such as a building. In such a case, the refrigerant line connected between the outdoor unit and each indoor unit in the air conditioner must be lengthened. Such a lengthened refrigerant line is prepared by connecting pipes of a suitable length by means of welding or the like. In this case, however, slag formed on welded portions of the pipes may be separated from inner surfaces of the pipes, and circulated together with a refrigerant in the air conditioner during operation of the air conditioner.

When foreign matter such as the above-mentioned slag, which circulates together with the refrigerant, is accumulated on a certain portion of the refrigerant line, the refrigerant cannot flow smoothly. In particular, when the foreign matter is accumulated in a mechanical part of the air conditioner, for example, a compressor, abrasion and malfunction of mechanical elements may occur. In this case, the performance and reliability of the air conditioner are degraded.

SUMMARY OF THE INVENTION

Accordingly, the present invention is directed to a refrigerant bypassing and filtering apparatus of an air conditioner and a method for controlling the same that substantially obviate one or more problems due to limitations and disadvantages of the related art.

An object of the present invention is to provide a refrigerant bypassing and filtering apparatus of an air conditioner which is capable of filtering a refrigerant in the air conditioner to remove foreign matter from the refrigerant, when the air conditioner is initially operated.

Another object of the present invention is to provide a refrigerant bypassing and filtering apparatus of an air conditioner which is capable of effectively removing foreign matter such as slag produced in a refrigerant line, not only when the air conditioner is initially operated, but also during normal operation of the air conditioner.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerant bypassing and filtering apparatus of an air conditioner comprises: at least one bypass line adapted to guide a refrigerant to bypass a main line through which the refrigerant flows between an outdoor unit and an indoor unit; a strainer arranged at the bypass line; a first valve arranged at the main line between opposite ends of the bypass line connected to the main line; and second valves arranged at the bypass line.

The strainer may be a bidirectional strainer through which the refrigerant is allowed to pass in forward and reverse directions. The strainer may be separably mounted to the bypass line.

The second valves may be arranged at opposite sides of the strainer, respectively.

The strainer may have a diameter larger than a pipe diameter of the bypass line. The strainer may comprise a hollow strainer body, and a filtering net fitted in the strainer body, the filtering net having a diameter larger than an inner diameter of the strainer body. The filtering net may be convex in a flow direction of the refrigerant in the strainer.

In another aspect of the present invention, an air conditioner comprises: an outdoor unit; at least one indoor unit; a main line which connects the indoor unit to the outdoor unit; at least one bypass line arranged at a predetermined portion of the main line, and adapted to define a flow path through which a refrigerant in the main line is bypassed; a strainer arranged at the bypass line without changing a flow direction of the refrigerant bypassed through the bypass line, the strainer comprising a hollow strainer body having a diameter larger than a diameter of the bypass line, and a filtering net fitted in the strainer body; a first valve arranged at the main line between opposite ends of the bypass line connected to the main line; and second valves arranged at the bypass line at opposite sides of the strainer, respectively.

The at least one bypass line may comprise at least one bypass line arranged at a first refrigerant line of the main line, through which the refrigerant flows from the outdoor unit to the indoor unit, downstream from a discharge side of an outdoor heat exchanger arranged in the outdoor unit, and at least one bypass line arranged at a second refrigerant line of the main line, through which the refrigerant flows from the indoor unit to the outdoor unit, upstream from a suction side of a compressor arranged in the outdoor unit.

The bypass line arranged at the second refrigerant line may be arranged between an indoor heat exchanger arranged in the indoor unit and an accumulator arranged in the outdoor unit.

The at least one indoor unit may comprise a plurality of indoor units connected to the second refrigerant line via a plurality of branch lines. In this case, the bypass line may be arranged between the compressor and the branch lines.

In another aspect of the present invention, a method for controlling a refrigerant bypassing and filtering apparatus of an air conditioner comprises: a bypass line opening step for opening a bypass line while closing a main line to guide a refrigerant to flow through the bypass line; a refrigerant filtering step for guiding the refrigerant to pass through a strainer; a strainer cleaning step; a reverse refrigerant filtering step for guiding the refrigerant to pass through the strainer in a direction reverse to a refrigerant flow direction at the refrigerant filtering step; and a main line opening step for opening the main line while closing the bypass line to guide the refrigerant to flow through the main line.

The bypass line opening step may comprise the steps of closing a first valve arranged at the main line, and opening second valves respectively arranged at the bypass line at opposite sides of the strainer.

The main line opening step may comprise the steps of opening the first valve, and closing the second valves.

The strainer cleaning step may comprise the steps of closing the first valve and second valves, separating the strainer from the bypass line, removing foreign matter present in the strainer, and mounting the strainer to the bypass line.

The method may further comprise an air purging step for removing air from the bypass line after execution of the strainer cleaning step.

The method may further comprise an additional strainer cleaning step executed after execution of the reverse refrigerant filtering step. In this case, the method may further comprise an air purging step for removing air from the bypass line after execution of the additional strainer cleaning step.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
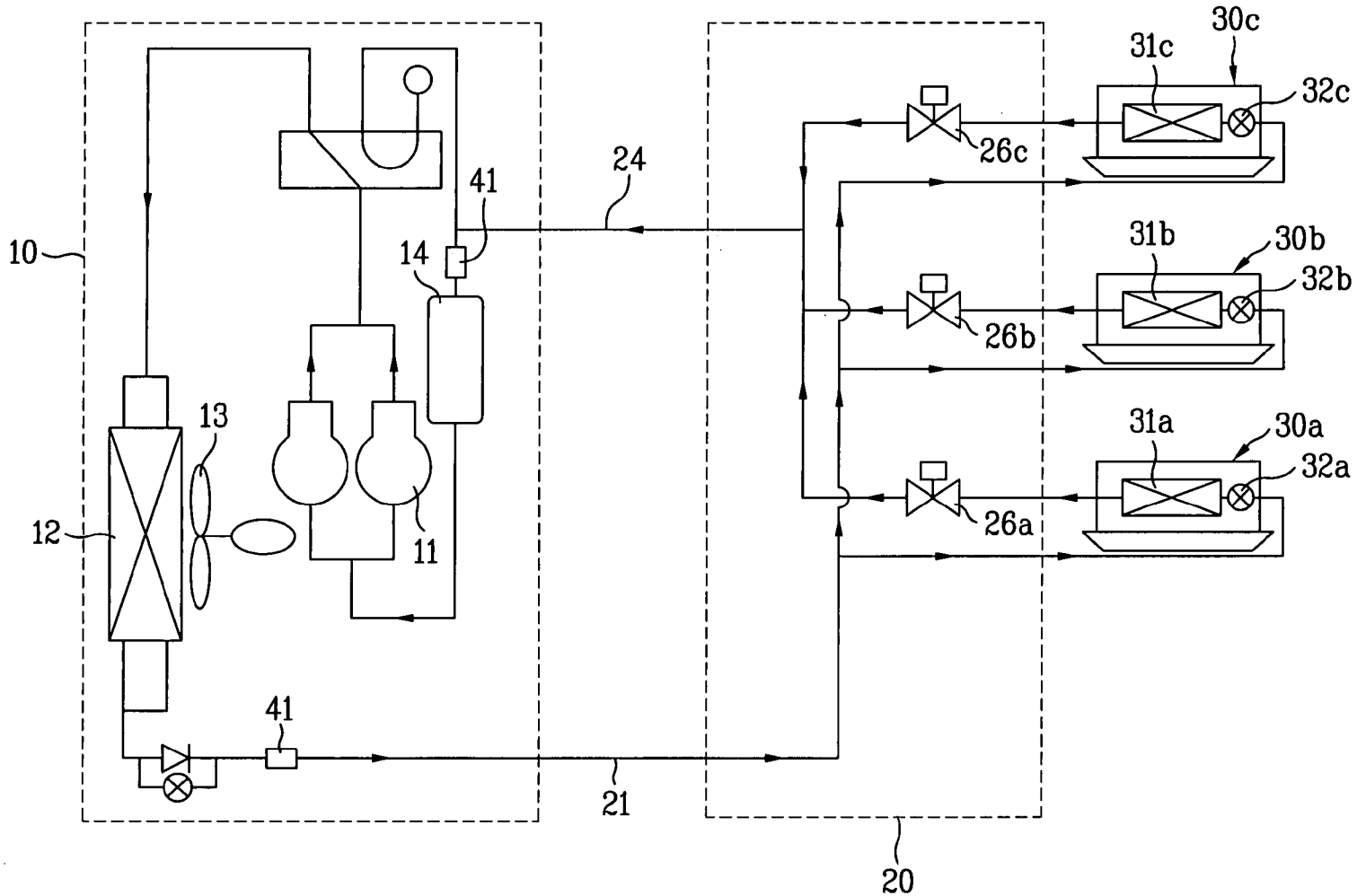
FIG. 1 is a schematic view illustrating a multi-unit air conditioner according to a first embodiment of the present invention.

FIG. 1 is a schematic view illustrating a multi-unit air conditioner according to a first embodiment of the present invention.

As shown in FIG. 1, the multi-unit air conditioner (hereinafter, simply referred to as an "air conditioner") mainly includes an outdoor unit 10, a distributor 20, and at least two indoor units (three indoor units 30*a*, 30*b*, and 30*c* are shown in the illustrated case). For simplicity, the following description will be given in conjunction with the case in which three indoor units 30*a*, 30*b*, and 30*c* are used. The outdoor unit 10 includes compressors 11, an outdoor heat exchanger 12, an outdoor fan 13, and an accumulator 14.

The indoor units 30*a*, 30*b*, and 30*c* are connected to the outdoor heat exchanger 12 by a first refrigerant line 21. The distributor 20 includes a plurality of branch lines branched from the first refrigerant line 21. The number of the branch lines corresponds to the number of the indoor units. The indoor units 30*a*, 30*b*, and 30*c* are also connected to the outdoor unit 10 by a second refrigerant line 24. The branch lines of the distributor 20 are joined into the second refrigerant line 24. The distributor 20 also includes a plurality of valve units 26*a*, 26*b*, and 26*c* respectively arranged at the branch lines downstream from the indoor units 30*a*, 30*b*, and 30*c*.

The indoor units 30*a*, 30*b*, and 30*c* include respective indoor heat exchangers 31*a*, 31*b*, and 31*c*, respective indoor fans (not shown), and respective expansion devices 32*a*, 32*b*, and 32*c*. Preferably, the expansion devices 32*a*, 32*b*, 32*c* are arranged at the branch lines of the distributor 20 upstream from the indoor units 30*a*, 30*b*, and 30*c*, respectively.

Refrigerant flows discharged from respective indoor units 30*a*, 30*b*, and 30*c* are joined through the second refrigerant line 24 which, in turn, guides the joined refrigerant into the outdoor unit 10.

Meanwhile, strainers 41 are arranged at a suction side of the compressors 11 and a discharge side of the outdoor heat exchanger 12, respectively, in order to filter a refrigerant flowing in the refrigerant lines, and thus, to remove foreign matter from the refrigerant.

Each strainer 41 includes a filtering net (not shown) having a predetermined mesh size. The filtering net is arranged in a predetermined pipe portion of the associated refrigerant line. When the refrigerant passes through the strainer 41, the filtering net (not shown) prevents foreign matter having a size larger than the mesh size of the filtering net (not shown) from passing through the strainer 41, while allowing the refrigerant to pass through the strainer 41.

It is preferred that the strainers 41 be arranged at the first refrigerant line 21 downstream from the discharge side of the outdoor heat exchanger 12, and at the second refrigerant line 24 upstream from the suction side of the compressor 11, in particular, between the discharge side of the indoor heat exchangers 31*a*, 31*b*, and 31*c* and the suction side of the accumulator 14, respectively.

Foreign matter, which flows in the refrigerant lines together with the refrigerant, mainly contains slag components. Such slag is mainly produced in the refrigerant lines during a pipe welding process carried out in the installation of the air conditioner. A large part of the slag is separated from the inner pipe surfaces of the refrigerant lines during an initial operation of the air conditioner, and is circulated through the refrigerant lines. Although such foreign matter is filtered out by the strainers 41 installed in the outdoor unit 10, the strainers 41 may be blocked when an excessive amount of foreign matter is accumulated in the strainers 41. For this reason, there is a problem in that it is necessary to periodically replace the strainers 41 with new ones.

Figure 2:
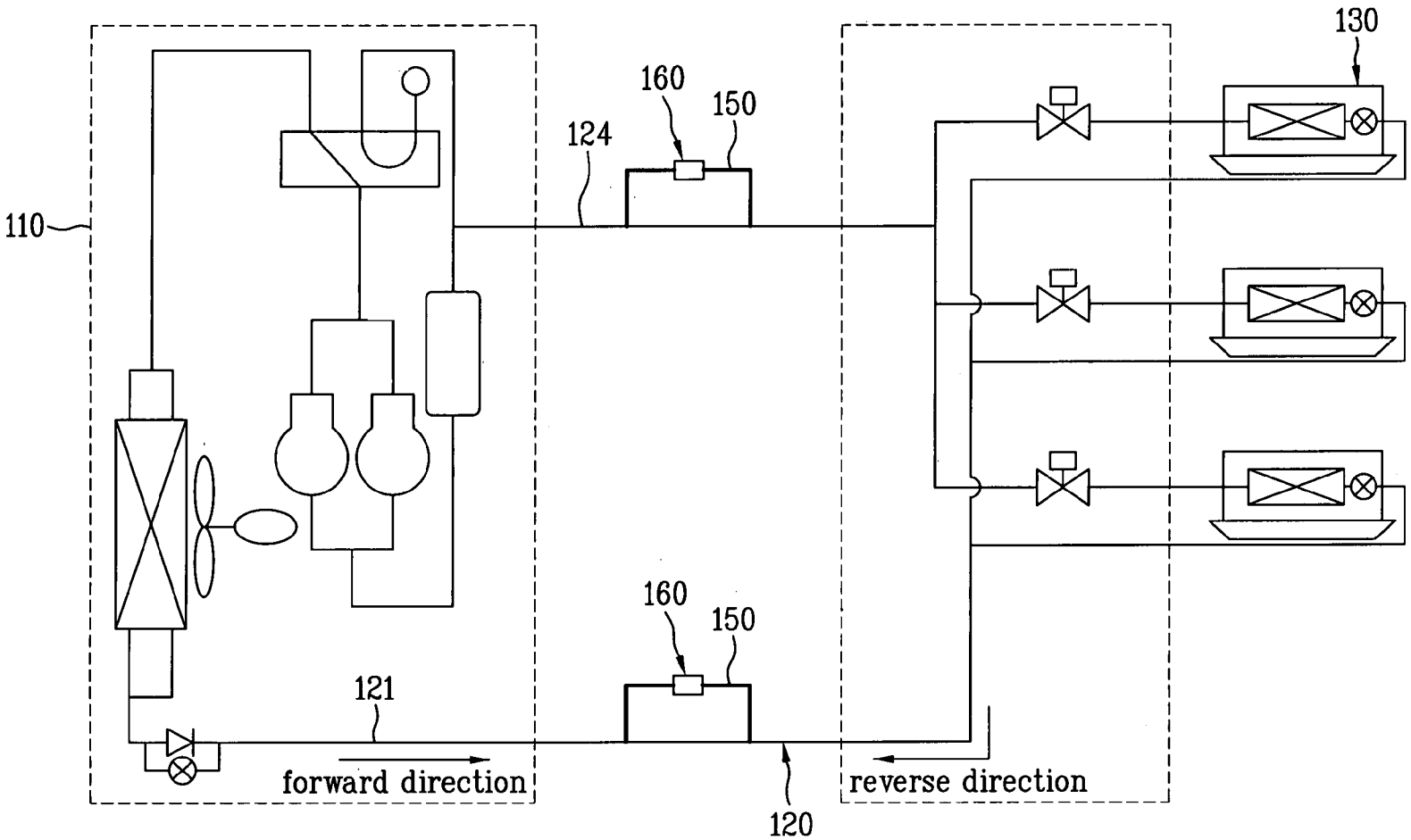
FIG. 2 is a schematic view illustrating a multi-unit air conditioner according to a second embodiment of the present invention.
Figure 3:
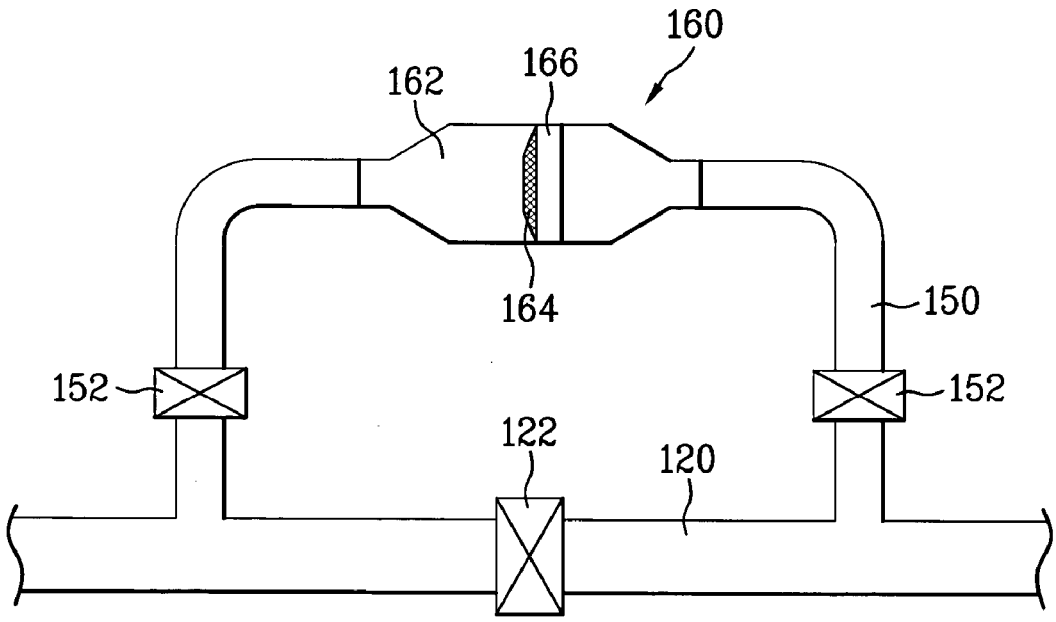
FIG. 3 is a sectional view illustrating a bypass line and a refrigerant bypassing and filtering apparatus illustrated in FIG. 2.

To this end, the present invention provides a refrigerant bypassing and filtering apparatus having an improved structure capable of solving the above-described problem incurred in the above-described air conditioner. FIGS. 2 and 3 illustrate the refrigerant bypassing and filtering apparatus which has an improved structure in accordance with a second embodiment of the present invention. Hereinafter, this refrigerant bypassing and filtering apparatus will be described in detail with reference to FIGS. 2 and 3.

As shown in FIG. 2, the refrigerant bypassing and filtering apparatus includes bypass lines 150 respectively arranged at refrigerant lines connected between an outdoor unit 110 and indoor units 130, that is, first and second refrigerant lines 121 and 124.

In the case illustrated in FIG. 2, the bypass lines 150 are illustrated as being provided such that only one bypass line 150 is arranged at each of the first and second refrigerant lines 121 and 124. However, where the refrigerant lines are long or have a plurality of bent portions, a plurality of bypass lines 150 may be provided at each refrigerant line, in order to prevent a degradation in foreign matter removal efficiency caused by the structure of the refrigerant lines. In this case, it is preferred that each bypass line be arranged just upstream from a refrigerant line portion where the flow velocity of the refrigerant is reduced, because foreign matter tends to be accumulated at the refrigerant line portion.

In the following description, the first and second refrigerant lines 121 and 124, which are main refrigerant lines, will be referred to as "main lines 120" compared to the bypass lines 150.

A strainer 160 is arranged at each bypass line 150 to filter the refrigerant flowing in the associated main line 120, and thus, to remove foreign matter such as slag from the refrigerant, as shown in FIG. 3.

It is preferred that the strainer 160 be separable from the associated bypass line 150.

Meanwhile, it is preferred that the strainer 160 be a bi-directional strainer which is applicable to both forward and reverse refrigerant flows.

The strainer 160 includes a hollow strainer body, and a filtering net 164 having a predetermined mesh size. The filtering net 164 is arranged in a flow passage 162 defined in the strainer body of the strainer 160. When the refrigerant passes through the strainer 160, the filtering net 164 prevents foreign matter having a size larger than the mesh size of the filtering net 164 from passing through the strainer 160, while allowing the refrigerant to pass through the strainer 160.

The strainer 160 is arranged at the associated bypass line 150 such that the flow passage 162 defined in the strainer body of the strainer 160 extends in the same direction as the flow direction of the refrigerant in the bypass line 150, in order to prevent the flow passage 162 from interfering with the refrigerant flow in the bypass line 150.

Also, it is preferred that the flow passage 162 of the strainer 160 have an inner diameter larger than the inner diameter of the bypass line 150, taking into consideration a flow resistance caused by the filtering net 164, and a flow resistance caused by a reduction in the cross-sectional area of the refrigerant flow through the flow passage 162 caused by the accumulation of foreign matter separated by the filtering net 164. Since an enhanced filtering effect is obtained when the filtering net 164 has an increased surface area, it is also preferred that the inner diameter of the strainer 160, that is, the inner diameter of the flow passage 162, be larger than the inner diameter of the bypass line 150. For the same reason, it is also preferred that the diameter of the filtering net 164 be larger than the inner diameter of the flow passage 162.

When the diameter of the filtering net 164 is larger than the inner diameter of the flow passage 162, the filtering net 164 is fitted in the flow passage 162 such that the central portion of the filtering net 164 is convex toward one side of the filtering net 164 in the flow direction of the refrigerant. The peripheral portion of the filtering net 164 is fixed to the inner peripheral surface of the flow passage 162 by a fixing member 166.

The convexity of the central portion of the filtering net 164 must not be excessive because the filtering net 164 has to be applicable to both forward and reverse refrigerant flows. In addition, it is preferred that the filtering net 164 have a gentle slope.

Although the strainer 160 has been described as having the above-described structure in accordance with the illustrated embodiment, the present invention is not limited thereto. Other structures may be used in the case in which the strainer 160 must be separable from the associated bypass line, and be applicable to both forward and reverse refrigerant flows.

A first valve 122 is arranged at each main line 120, to which the associated bypass line 150 is connected, between opposite ends of the associated bypass line 150 connected to the main line 120. The first valve 122 serves to open/close the associated main line 120.

Second valves 152 are also arranged at each bypass line 150 at opposite sides of the associated strainer 160, respectively, in order to open/close the bypass line 150.

When the air conditioner is initially operated after the installation thereof under the condition in which the first valve 122 is closed, and the second valves 152 are opened, the refrigerant is guided to pass through the associated strainer 160 while being bypassed through the associated bypass line 150. Accordingly, the refrigerant is filtered to remove foreign matter contained therein.

The present invention also provides a method for controlling a refrigerant bypassing and filtering apparatus of an air conditioner, which includes a bypass line opening step for opening a bypass line while closing a main line, a refrigerant filtering step for guiding a refrigerant to pass through a strainer, a strainer cleaning step, a reverse refrigerant filtering step for guiding the refrigerant to pass through the strainer in a direction reverse to that of the refrigerant filtering step, and a main line opening step for opening the main line while closing the bypass line.

In accordance with the present invention, the control method further includes an air purging step for removing air from the bypass line after execution of the strainer cleaning step.

Hereinafter, the method for controlling a refrigerant bypassing and filtering apparatus of an air conditioner in accordance with the present invention will be described with reference to the annexed drawings.

The following description will be given with reference to the configuration according to the embodiment illustrated in FIGS. 2 and 3, as the configuration of the apparatus to which the control method is applied. For convenience and simplicity of description, the same titles and reference numerals as those of the above described configuration are used in the following description to refer to the same or like parts.

In the following description, it is also assumed that the flow direction of the refrigerant flowing from the outdoor unit 110 to the indoor units 130 via the first refrigerant line 121 in the multi-unit air conditioner of FIG. 2 is referred to as a "forward flow direction", and the flow direction of the refrigerant flowing from the indoor units 130 to the outdoor unit 110 via the second refrigerant line 124 is referred to as a "reverse flow direction".

Figure 4:
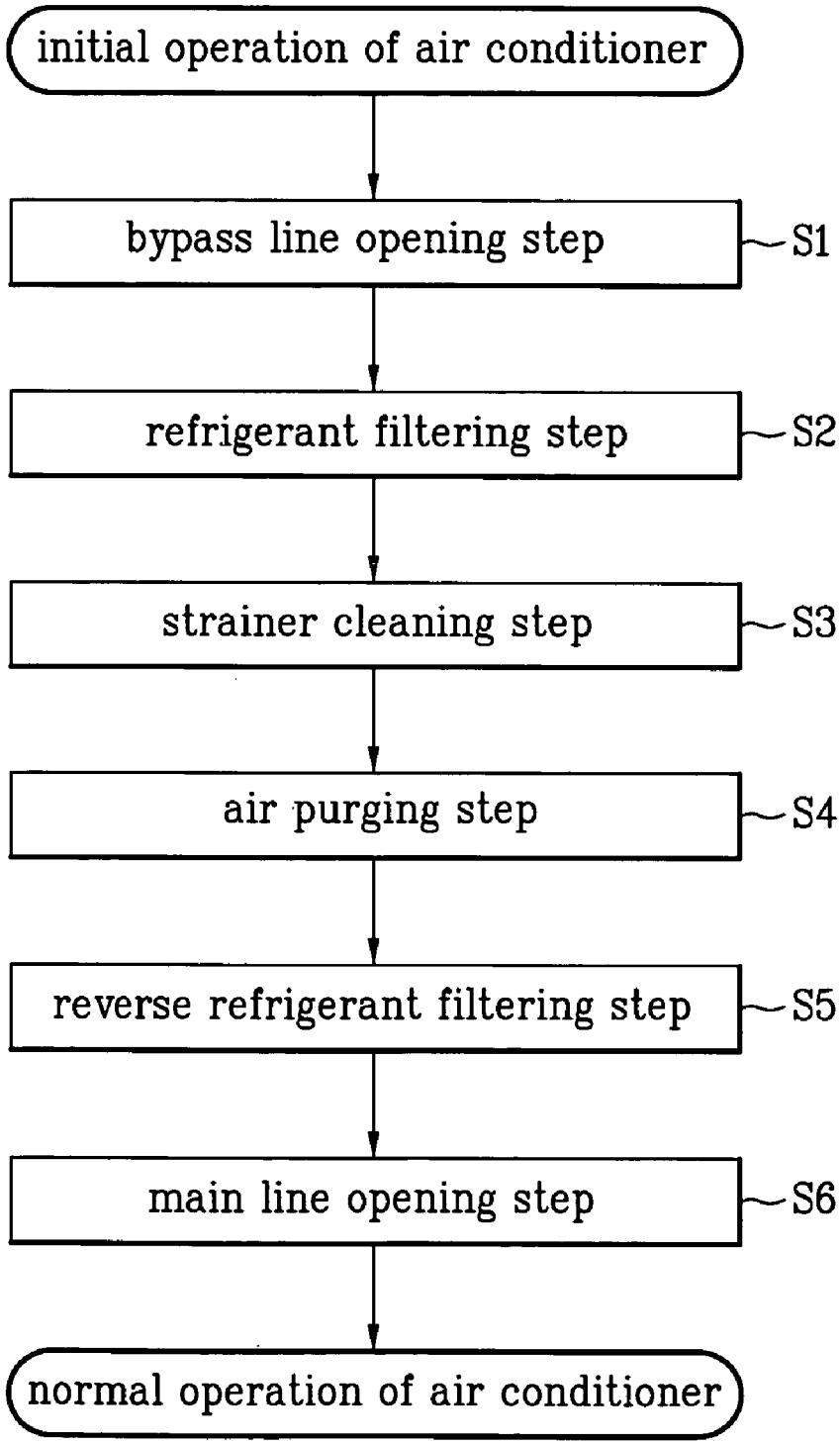
FIG. 4 is a flow chart illustrating a method for controlling the refrigerant bypassing and filtering apparatus of the air conditioner in accordance with the present invention.

FIG. 4 is a flow chart illustrating the method for controlling the refrigerant bypassing and filtering apparatus of the air conditioner in accordance with the present invention.

When the air conditioner is initially operated after the installation thereof, foreign matter, which is present in a large amount in the refrigerant lines, and includes slag formed on inner surfaces of welded pipe portions of the refrigerant lines, flows along the refrigerant lines, together with a refrigerant.

In order to remove the slag present in the refrigerant lines of the air conditioner, the method for controlling the refrigerant bypassing and filtering apparatus of the air conditioner in accordance with the present invention is executed. For simplicity, the following description will be given only in conjunction with one strainer.

In accordance with this method, a bypass line opening step S1 is first executed. At the bypass line opening step S1, the second valves 152 respectively arranged at opposite sides of the strainer 160 are opened, and the first valve 122 is closed. As a result, the refrigerant is prevented from flowing through the main line 120 while being bypassed through the bypass line 150.

Since the strainer 160 is arranged at the bypass line 150, the refrigerant, which is bypassed through the bypass line 150, passes through the strainer 160. Accordingly, a refrigerant filtering step S2 is executed. That is, the refrigerant is filtered by the strainer 160 to separate slag and other foreign matter from the refrigerant at the refrigerant filtering step S2.

The foreign matter separated by the strainer 160 arranged at the bypass line 150 mainly includes slag present in the first refrigerant line 121 between the outdoor unit 110 and the strainer 160 of the bypass line 150, and slag present in the second refrigerant line 124 between the indoor units 130 and the strainer 160 of the bypass line 150.

After execution of the refrigerant filtering step S2, a strainer cleaning step S3 is executed to remove the foreign matter separated by the strainer 160, and thus, to clean the strainer 160.

At the strainer cleaning step S3, the strainer 160, which is separably mounted to the bypass line 150, is separated from the bypass line 150. The separation of the strainer 160 is executed under the condition in which both the first valve 122 and the second valves 152 are in a closed state to prevent the refrigerant from being outwardly discharged through the bypass line 150. Thereafter, the foreign matter attached to the filtering net 164 of the separated strainer 160 is removed to clean the strainer 160. Subsequently, the strainer 160 is again mounted to the bypass line 150.

After the cleaning of the strainer 160, an air purging step S4 is preferably executed.

Here, "air purge" means a process for removing air introduced into the strainer 160 and bypass line 150 during the process of cleaning the strainer 160. Since this process is well known to persons skilled in the art, no further description thereof will be given.

After execution of the air purging step S4, a reverse refrigerant filtering step S5 is executed to again perform a filtering process under the condition in which the flow direction of the refrigerant is reversed.

At the reverse refrigerant filtering step S5, the refrigerant is reversely circulated under the condition in which the first valve 122 is closed, and the second valves 152 are opened, in order to bypass the refrigerant through the bypass line 150, similarly to the refrigerant filtering step S2.

Accordingly, as the refrigerant passes through the strainer 160 while being bypassed through the bypass line 150, foreign matter present in the first refrigerant line 121 between the indoor units 130 and the strainer 160 of the bypass line 150, and foreign matter present in the second refrigerant line 124 between the outdoor unit 110 and the strainer 160 of the bypass line 150.

The reason why the strainer cleaning step S3 is executed prior to the reverse refrigerant filtering step S5 is to prevent the foreign matter separated by and attached to the filtering net 164 of the strainer 160 from being again circulated by the refrigerant flowing reversely in the air conditioner.

After execution of the reverse refrigerant filtering step S5, a main line opening step S6 is executed. At the main line opening step S6, the first valve 122 is opened to open the main line 120. On the other hand, the second valves 152 are closed to close the bypass line 150. As a result, the refrigerant can flow only through the main line 120.

As the refrigerant is circulated through the main line 120, the air conditioner operates normally to perform a heating or cooling operation.

Meanwhile, the strainer cleaning step may be executed again after execution of the reverse refrigerant filtering step S5, but before execution of the main line opening step S6, in order to remove the foreign matter collected in the strainer 160. In addition, after execution of this strainer cleaning step, the air purging step may be executed again to remove air introduced into the refrigerant during the strainer cleaning step.

Thus, it is possible to remove foreign matter such as slag produced in the refrigerant lines during the initial operation of the air conditioner carried out after the installation of the air conditioner in accordance with the refrigerant bypassing and filtering apparatus and the control method thereof.

The refrigerant bypassing and filtering apparatus of the air conditioner and the control method thereof according to the present invention, which have been described, have various effects.

That is, first, it is possible to effectively remove foreign matter such as slag produced in the refrigerant lines during the initial operation of the air conditioner carried out after the installation of the air conditioner. Accordingly, it is possible to reduce failure of the air conditioner, and to achieve an enhancement in the reliability of the air conditioner.

Second, it is possible to achieve removal of foreign matter even when problems caused by slag occur during normal operation of the system other than the initial operation, after the installation of the air conditioner. Accordingly, it is possible to achieve easy maintenance and repair, and to reduce the time taken for the maintenance and repair.

Third, even when a large amount of foreign matter is accumulated in the strainer, there is no problem associated with the normal operation of the air conditioner because the strainer is arranged at the bypass line. Accordingly, it is possible to achieve an enhancement in the operation efficiency of the air conditioner.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerant bypassing and filtering apparatus of an air conditioner comprising:

at least one bypass line adapted to guide a refrigerant to bypass a main line through which the refrigerant flows between an outdoor unit and an indoor unit;

a strainer arranged at the bypass line;

a first valve arranged at the main line between opposite ends of the bypass line connected to the main line; and second valves arranged at the bypass line.

2. The refrigerant bypassing and filtering apparatus according to claim 1, wherein the strainer is a bidirectional strainer through which the refrigerant is allowed to pass in forward and reverse directions.

3. The refrigerant bypassing and filtering apparatus according to claim 1, wherein the strainer is separably mounted to the bypass line.

4. The refrigerant bypassing and filtering apparatus according to claim 1, wherein the second valves are arranged at opposite sides of the strainer, respectively.

5. The refrigerant bypassing and filtering apparatus according to claim 1, wherein the strainer has a diameter larger than a pipe diameter of the bypass line.

6. The refrigerant bypassing and filtering apparatus according to claim 1, wherein the strainer comprises a hollow strainer body, and a filtering net fitted in the strainer body, the filtering net having a diameter larger than an inner diameter of the strainer body.

7. The refrigerant bypassing and filtering apparatus according to claim 6, wherein the filtering net is convex in a flow direction of the refrigerant in the strainer.

8. An air conditioner comprising:

an outdoor unit;

at least one indoor unit;

a main line which connects the indoor unit to the outdoor unit;

at least one bypass line arranged at a predetermined portion of the main line, and adapted to define a flow path through which a refrigerant in the main line is bypassed;

a strainer arranged at the bypass line without changing a flow direction of the refrigerant bypassed through the bypass line, the strainer comprising a hollow strainer body having a diameter larger than a diameter of the bypass line, and a filtering net fitted in the strainer body;

a first valve arranged at the main line between opposite ends of the bypass line connected to the main line; and second valves arranged at the bypass line at opposite sides of the strainer, respectively.

9. The air conditioner according to claim 8, wherein the at least one bypass line comprises:

at least one bypass line arranged at a first refrigerant line of the main line, through which the refrigerant flows from the outdoor unit to the indoor unit, downstream from a discharge side of an outdoor heat exchanger arranged in the outdoor unit; and at least one bypass line arranged at a second refrigerant line of the main line, through which the refrigerant flows from the indoor unit to the outdoor unit, upstream from a suction side of a compressor arranged in the outdoor unit.

10. The air conditioner according to claim 9, wherein the bypass line arranged at the second refrigerant line is arranged between an indoor heat exchanger arranged in the indoor unit and an accumulator arranged in the outdoor unit.

11. The air conditioner according to claim 9, wherein:

the at least one indoor unit comprises a plurality of indoor units connected to the second refrigerant line via a plurality of branch lines; and the bypass line is arranged between the compressor and the branch lines.

12. A method for controlling a refrigerant bypassing and filtering apparatus of an air conditioner, comprising:

a bypass line opening step for opening a bypass line while closing a main line to guide a refrigerant to flow through the bypass line;

a refrigerant filtering step for guiding the refrigerant to pass through a strainer;

a strainer cleaning step;

a reverse refrigerant filtering step for guiding the refrigerant to pass through the strainer in a direction reverse to a refrigerant flow direction at the refrigerant filtering step; and a main line opening step for opening the main line while closing the bypass line to guide the refrigerant to flow through the main line.

13. The method according to claim 12, wherein the bypass line opening step comprises the steps of closing a first valve arranged at the main line, and opening second valves respectively arranged at the bypass line at opposite sides of the strainer.

14. The method according to claim 12, wherein the main line opening step comprises the steps of opening a first valve arranged at the main line, and closing second valves respectively arranged at the bypass line at opposite sides of the strainer.

15. The method according to claim 12, wherein the strainer cleaning step comprises the steps of:

closing a first valve arranged at the main line, and closing second valves respectively arranged at the bypass line at opposite sides of the strainer;

separating the strainer from the bypass line;

removing foreign matter present in the strainer; and mounting the strainer to the bypass line.

16. The method according to claim 12, further comprising:

an air purging step for removing air from the bypass line after execution of the strainer cleaning step.

17. The method according to claim 12, further comprising:

an additional strainer cleaning step executed after execution of the reverse refrigerant filtering step.

18. The method according to claim 17, further comprising:

an air purging step for removing air from the bypass line after execution of the additional strainer cleaning step.

* * * * *